US007144515B2

(12) United States Patent
Brosemer

(10) Patent No.: US 7,144,515 B2
(45) Date of Patent: Dec. 5, 2006

(54) METHOD AND APPARATUS FOR IMPROVING SWIMMING POOL SKIMMER EFFICIENCY

(76) Inventor: Brandyn Brosemer, 138 S. Telegraph Hill Rd., Holmdel, NJ (US) 07733

( * ) Notice: Subject to any disclaimer, the term of this patent is extended or adjusted under 35 U.S.C. 154(b) by 234 days.

(21) Appl. No.: 10/958,804

(22) Filed: Oct. 5, 2004

(65) Prior Publication Data

US 2006/0070935 A1 Apr. 6, 2006

(51) Int. Cl.
*E04H 4/16* (2006.01)
*E04H 4/12* (2006.01)
*B01D 29/25* (2006.01)
*B01D 21/26* (2006.01)

(52) U.S. Cl. ..... 210/787; 210/169; 210/416.2; 210/448; 210/512.1; 4/507; 137/808

(58) Field of Classification Search ..... 210/787, 210/169, 416.1, 416.2, 448, 512.1; 4/507; 137/808

See application file for complete search history.

(56) References Cited

U.S. PATENT DOCUMENTS 1,704,634 A * 3/1929 Snider ..... 210/445
3,268,079 A * 8/1966 Sharrow, Jr. ..... 210/169
3,306,488 A * 2/1967 Lemelson ..... 220/62.17
3,597,902 A * 8/1971 Williams ..... 55/337
3,628,664 A * 12/1971 Stanwood ..... 210/169
3,701,427 A * 10/1972 Howard ..... 210/169
3,940,807 A * 3/1976 Baker et al. ..... 4/490
4,725,352 A * 2/1988 Haliotis ..... 210/169

* cited by examiner

*Primary Examiner*—Fred G. Prince
(74) *Attorney, Agent, or Firm*—Brosemer, Kolefas & Associates

(57) ABSTRACT

An improved pool skimmer apparatus and method that enhances the effectiveness of a swimming pool skimmer assembly. In particular, my inventive method and apparatus makes pool skimmers more effective at capturing floating debris and directing it to the pool filter system where it is removed from the pool water. According to my invention, a skimmer basket assembly includes an open top, cylindrical sidewalls, and a mesh bottom. Disposed along the sidewalls are a plurality of "fins" or "blades", positioned such that water entering the basket assembly develops a circular flow, causing floating debris to be drawn down into the filtering system. In this manner, particularly difficult to remove floating debris, such as pollen, are drawn down to be filtered rather than remain floating on a top portion of skimmer and/or pool water. Alternative embodiments of my invention include a plurality of blades disposed directly along the interior walls of the skimmer assembly, thereby promoting the circular flow and enhanced skimming.

9 Claims, 5 Drawing Sheets

METHOD AND APPARATUS FOR IMPROVING SWIMMING POOL SKIMMER EFFICIENCY

FIELD OF THE INVENTION

This invention relates generally to the field pool cleaning and filtration. In particular, it relates to a method and apparatus for improving the efficiency of a swimming pool skimmer.

BACKGROUND OF THE INVENTION

Conceptually, swimming pools are pretty simple—they're just big basins of water. But on a hot summer day, a swimming pool can seem like the greatest invention known to man. Basically, a swimming pool needs only seven major components, namely: a basin; a pump; a filter; a chemical feeder; drains; returns and plumbing connecting the components.

As is known, the basic operational idea behind swimming pools is to pump water in a continual cycle, from the pool through a filtering and chemical treatment system and back to the pool again. In this way, the pumping system keeps the water in the pool relatively free of dirt, debris, algae and bacteria. Some pools also include heaters in the mix, in order to keep the water at or above a certain temperature.

Given its importance to the sanitary operation of a swimming pool, methods and apparatus that improve the effectiveness of debris removal from swimming pool water would represent an important improvement in the art. Such is the subject of the present invention.

SUMMARY OF THE INVENTION

I have developed a method and accompanying apparatus for enhancing the effectiveness of a swimming pool skimmer assembly. In particular, my inventive method and apparatus makes pool skimmers more effective at capturing floating debris and directing it to the pool filter system where it is removed from the pool water.

Viewed from a first aspect, my invention is directed towards a novel skimmer basket assembly having an open top, cylindrical sidewalls, and a mesh bottom. Disposed along the sidewalls are a plurality of "fins" or "blades", positioned such that water entering the basket assembly develops a circular flow, causing floating debris to be drawn down into the filtering system. In this manner, particularly difficult to remove floating debris, such as pollen, are drawn down to be filtered rather than remain floating on a top portion of skimmer and/or pool water.

Viewed from another aspect, my invention is directed to a novel pool skimmer, having a plurality of blades positioned along interior walls of the skimmer such that a circular flow is developed.

Viewed from still another aspect, my invention is directed to a method for promoting the effectiveness of pool skimmers, and a corresponding method for retrofitting existing pool skimmer assemblies.

Further features and advantages of my invention will become more readily apparent with reference to the accompanying drawing and illustrative detailed description.

DETAILED DESCRIPTION

Figure 1:
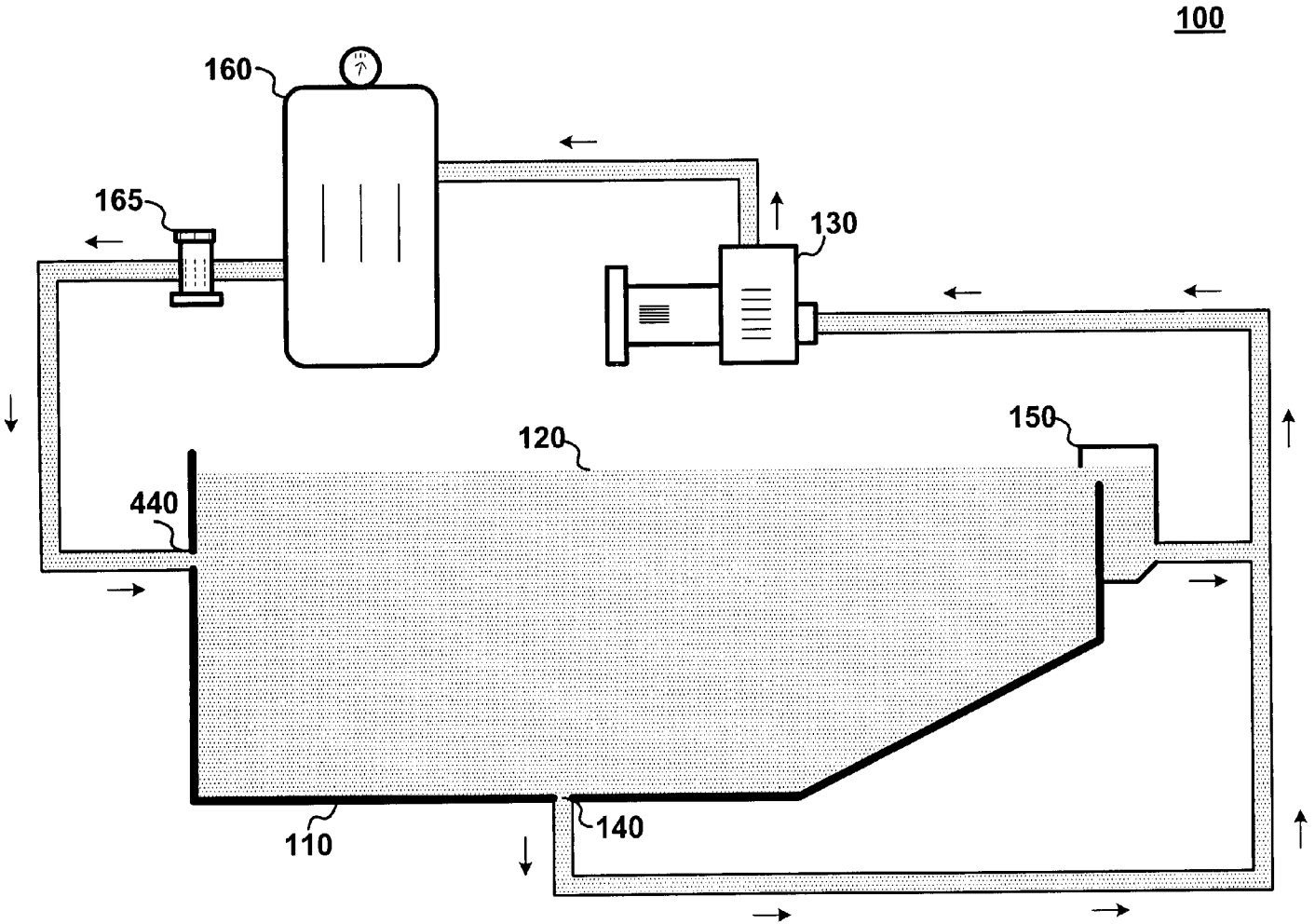
FIG. 1 (PRIOR ART)
FIG. 1 shows a simplified, prior art swimming pool equipment configuration including filter, pump, skimmer, and plumbing.

Illustrative examples of my invention will now be presented with reference to the attached drawing. Referring to FIG. 1, there is shown a simplified diagram of a swimming pool equipment configuration one may find in a typical residential or municipal swimming pool. Pool basin 110 contains pool water 120 that is circulated, filtered and sanitized by the pool equipment.

In particular, pool water 120 is drawn from the pool basin 110 through both skimmer 150 and drain(s) 140 by the action of pump 130 through the interconnect plumbing. The drawn water is pumped through filter 160—which removes undissolved contaminants, through chemical feeder 165 which adds sanitizing chemicals (chlorine, bromine, ozone, etc) to the circulating water prior to its being reintroduced to the pool basin 110 through inlet(s) 440.

Figure 2:
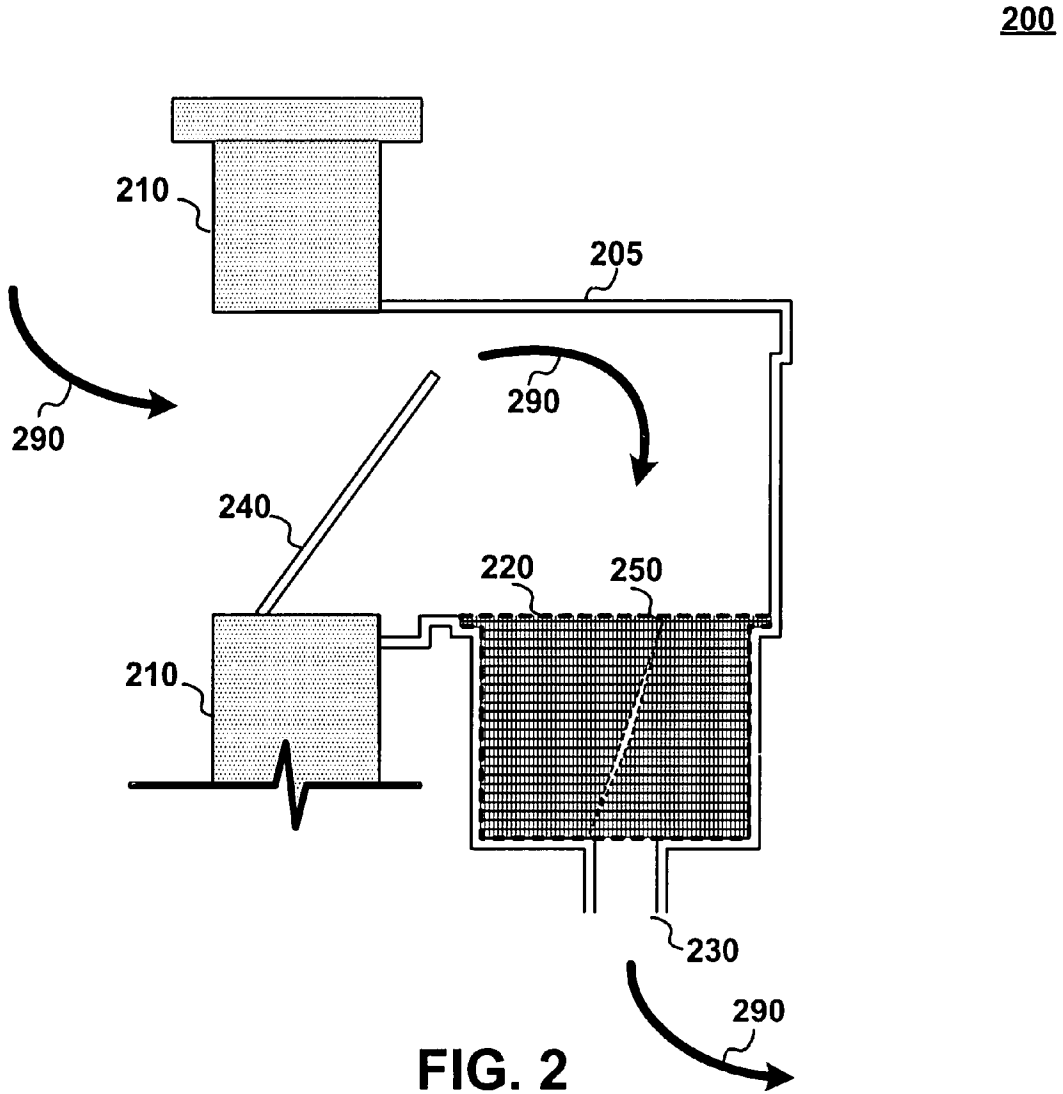
FIG. 2 shows a pool skimmer assembly according to the present invention.

Of particular importance to the operation of the system is the action of the pool skimmer 150, which captures floating debris and/or contaminants. Turning now to FIG. 2, there is shown a simplified diagram of a skimmer assembly 200 according to my invention.

The purpose of the skimmer 200, as the name implies is to pull water into the pump/filtering system from the surface of the pool water with a skimming action, pulling in leaves, oil, dirt and pollen before they can sink to the bottom of the pool, and also thereby providing a conveniently located suction line for vacuuming the pool. Most skimmers made today are molded, one-piece plastic units. Many pools have more than one skimmer.

With continued reference to FIG. 2, most skimmers such as 200 are built into the pool decking and walls 210 and are accessed via a cover 205. Pool water is drawn into the skimmer (depicted by arrow 290), and pours over floating weir 240 that allows debris to enter, but when the pump is shut off and the suction stops, the weir 240 floats into a vertical position, preventing debris from floating back into the pool. Some skimmers have no such weir 240 but instead use a floating barrel (not shown) as part of the skimmer basket 220.

The skimmer basket 220 collects leaves and large debris so that they may be easily removed. A disadvantage of weirs such as 240, is that leaves or other debris may cause them to jam in a fixed position thus preventing water from flowing into the skimmer 200 or allowing debris to return to the pool basin water when the pump is shut off. Water containing dissolved or very small debris that are not captured in skimmer basket 220, are drawn to the pump/filter system through outlet 230.

At this point, and with this structural background in place, it is appropriate to discuss my invention. As can be appreciated, some floating debris such as pollen, and/or oil, do not get directly drawn down into the outlet 230 since they remain floating on the surface of the skimmer water. As such, they may collect in the skimmer 200, and seep back into the pool basin water when the pump is turned off.

According to my invention however, this drawback to current skimmers is overcome through the use of my inventive "blades" or "fins" 250 which are disposed along the walls of the skimmer basket 220 and angled such that water entering the skimmer and drawn through the skimmer basket 220 to the outlet 230, is circularly circulated such that floating debris (like pollen) is drawn down into the resulting vortex (not shown). In this manner, very light floating debris such as pollen or oil is pulled through the filter basket to the pump/filter assembly where it is captured by the filter.

Figure 3:
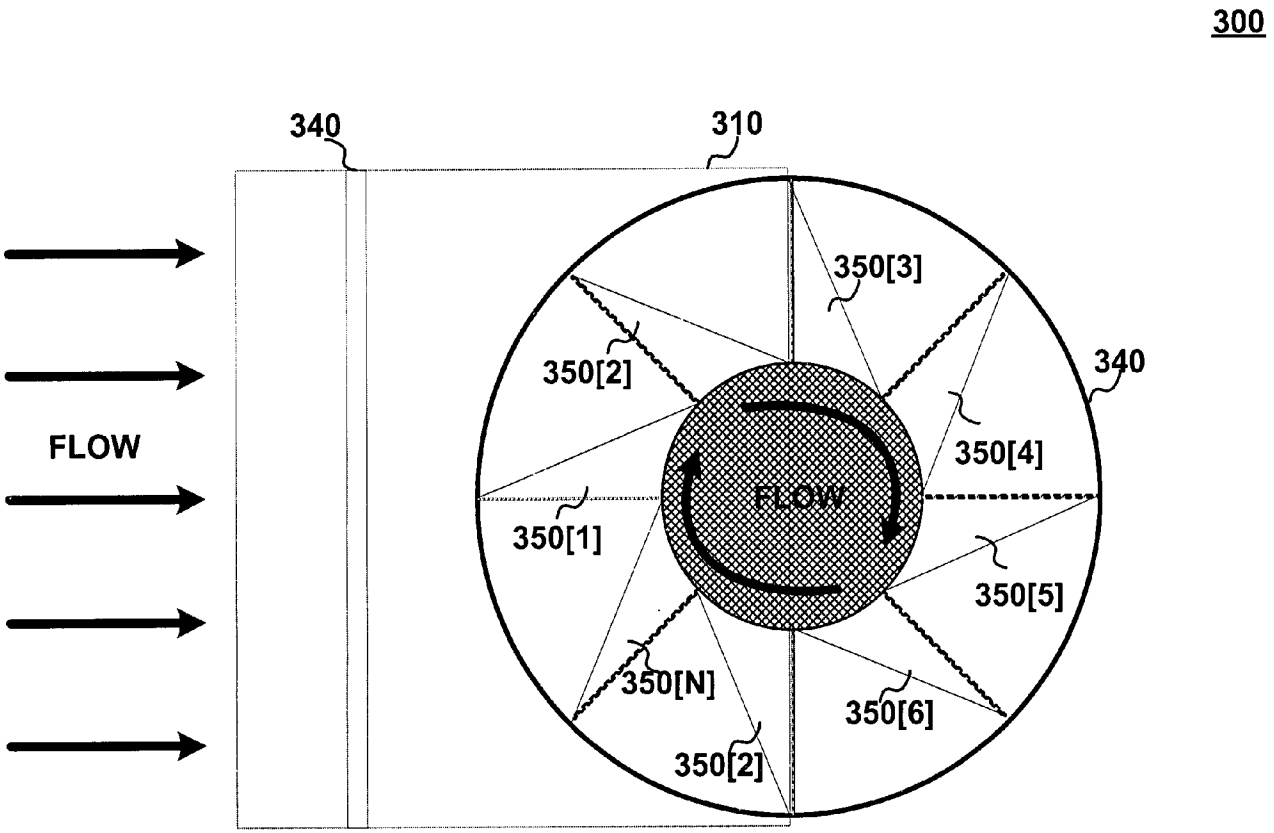
FIG. 3 shows a cutaway top view of a pool skimmer assembly according to the present invention.

This action may be more readily visualized by inspecting FIG. 3, which shows a cutaway top view of a pool skimmer 300. With reference to that FIG. 3, pool water drawn into the skimmer body 310 passes over weir 340 and into skimmer where it passes through filter basket 340, shown having cylindrical sides and a mesh, filtering bottom. Disposed along the walls of the sides, at a suitable angle, are blades 350[1] . . . 350[N]. Water entering the basket 340 is directed in a circularly through the action of the blades 350[1] . . . 350[N]. The resulting vortex (depicted by arrows) effectively draws down floating debris to the bottom of the basket. Very small debris including pollen and/or oils, are further drawn to the filter system where they may be removed.

Figure 4:
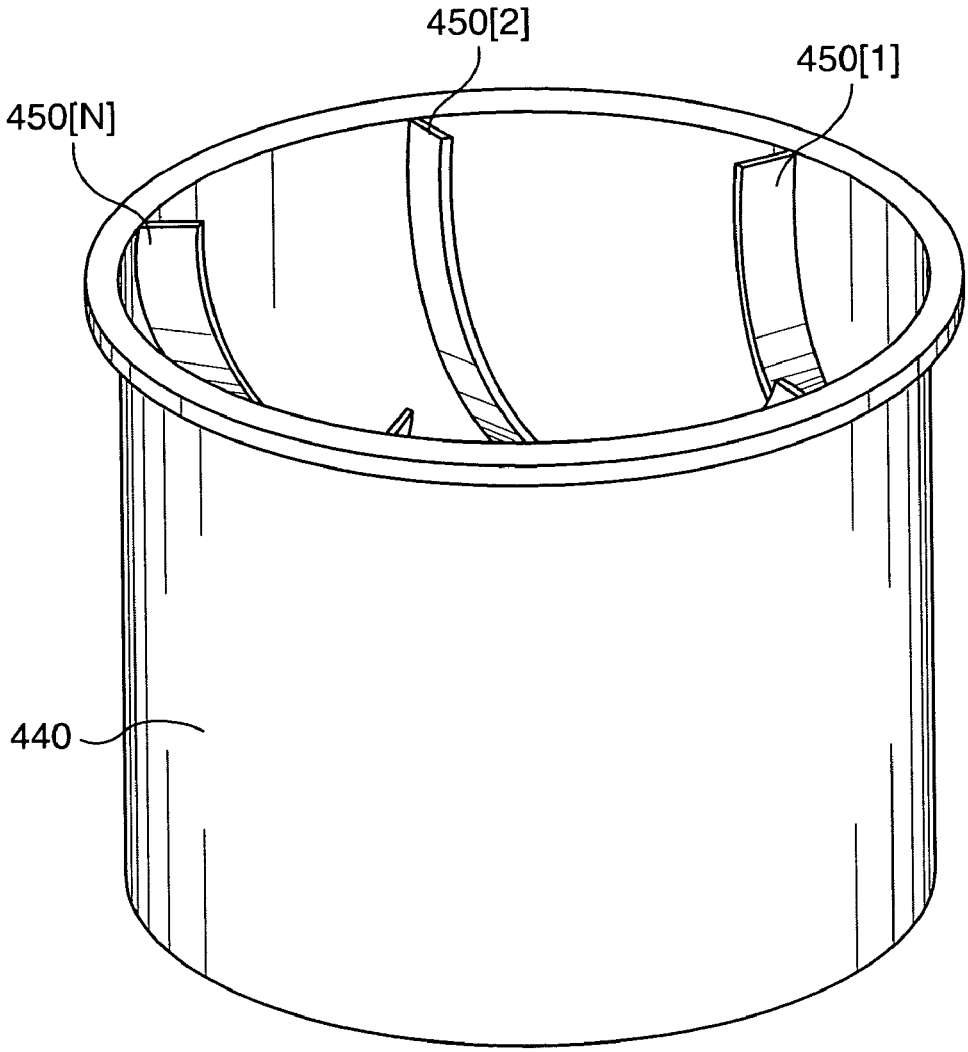
FIG. 4 shows a perspective view of a pool skimmer filter basket according to the present invention.

FIG. 4 is a perspective view of my inventive skimmer filter basket. Specifically, this embodiment of the filter basket includes solid walls 440, the inside of which have attached a plurality of blades 450[1] . . . 450[N]. Advantageously, and according to my invention, the filter basket assembly may have mesh sides (not specifically shown in this FIG. 4) or solid ones such as those shown. Still further, blades 450[1] . . . 450[N] may be straight or curved, such as those shown.

Figure 5:
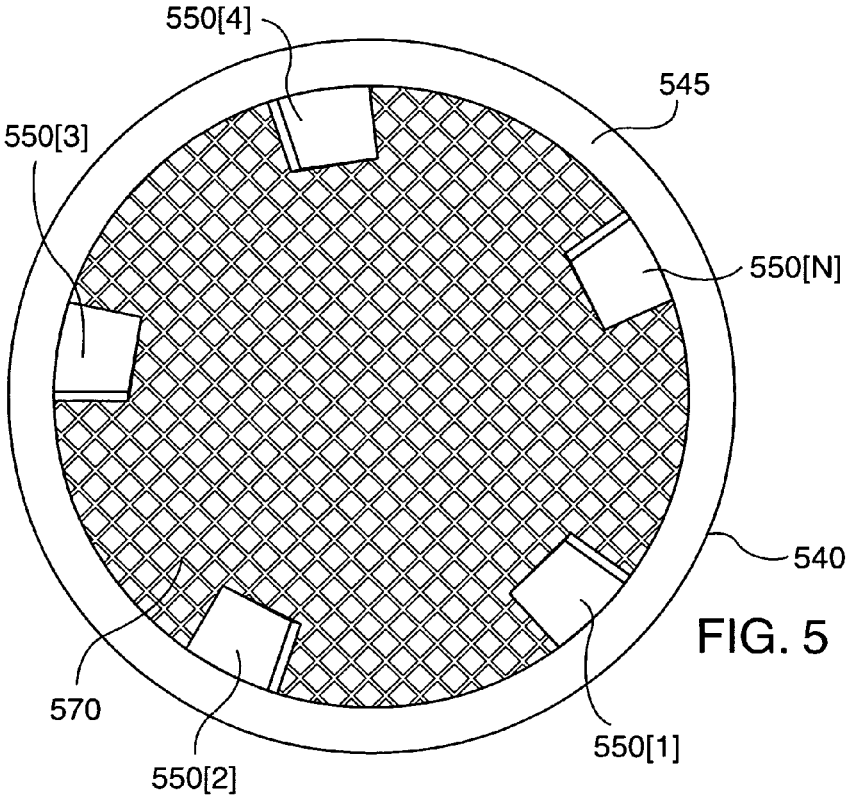
FIG. 5 shows a top view of a pool skimmer filter basket according to the present invention.

FIG. 5 is a top view of the skimmer filter basket according to the present invention. In particular filter basket includes an open top lip 545, attached to cylindrical sidewalls 540 which further attaches to mesh bottom 570. Disposed along inner cylindrical sidewalls 540 are blades 550[1] . . . 550[N] which impart circular flow on water flowing through basket from top through bottom 570. While not specifically shown in this FIG. 5, the blades 550[1] . . . 550[N] may be constructed such that they have an increasing width as one progresses from top to bottom. In this manner, the resulting vortex becomes increasingly "tight" as you approach the bottom of the skimmer basket. Such a design further draws floating debris into the filtering system.

Figure 6:
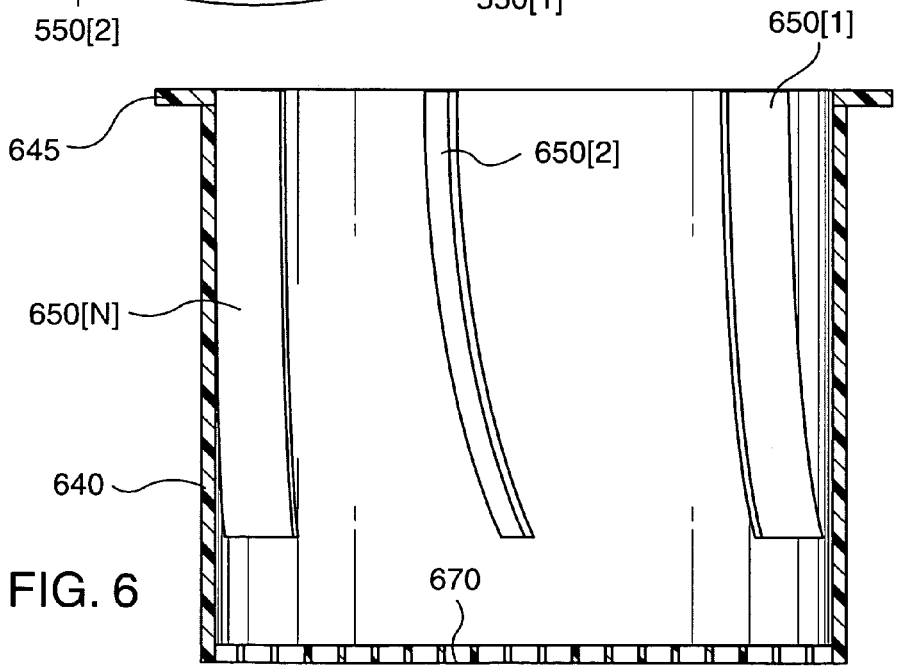
FIG. 6 shows a cutaway side view of a pool skimmer filter basket according to the present invention.

Lastly, FIG. 6 shows a cutaway side view of a skimmer filter basket constructed according to my inventive teachings. In particular, one can readily observe curved blades 650[1 ] . . . 650[N], disposed along inner walls 640 of skimmer basket. The walls in this basket are shown perforated, allowing water to be drawn through them as well as porous, mesh bottom 670.

Of course, it will be understood by those skilled in the art that the foregoing is merely illustrative of the principles of this invention, and that various modifications can be made by those skilled in the art without departing from the scope and spirit of the invention. Accordingly, my invention is to be limited only by the scope of the claims attached hereto.

What is claimed is:

1. A swimming pool skimmer comprising:

an inlet, for receiving pool water to be skimmed;

an outlet, through which the received water is withdrawn; and a circulator basket, positioned between the inlet and the outlet, said circulator basket including:

a porous bottom;

cylindrical sidewalls extending from the porous bottom; and a plurality of blades, disposed along and fixed to the sidewalls;

such that water entering the circulator basket from the inlet is circularly directed through the action of the blades as it is withdrawn through the porous bottom to the outlet.

2. The swimming pool skimmer according to claim 1 wherein the cylindrical sidewalls of the circulator basket are non-porous.

3. The swimming pool skimmer according to claim 1 wherein the cylindrical sidewalls of the circulator basket are porous.

4. The swimming pool skimmer according to claim 1 wherein the blades become increasingly wider in width as one progresses from a top towards the bottom.

5. An enhanced skimmer basket comprising:

a porous bottom;

cylindrical sidewalls extending from the porous bottom; and a plurality of blades, disposed along an inner portion of the sidewalls such that water entering the basket, passing over the blades and out the porous bottom is directed circularly in direction by the blades.

6. The skimmer basket according to claim 5 wherein said sidewalls are non-porous.

7. The skimmer basket according to claim 5 wherein said sidewalls are porous.

8. A method of producing enhanced pool skimming comprising the steps of:

receiving, a volume of pool water into a body of a pool skimmer;

circularly circulating, the received volume of pool water through the action of the water being drawn across a plurality of blades, positioned along interior perimeter walls of the skimmer; and discharging the circularly circulating water through an outlet in the skimmer;

such that an effective vortex is formed from the circularly circulating water and floating debris is drawn down into the vortex and the outlet.

9. The method according to claim 8 wherein the plurality of blades are disposed along an inner wall of a removable basket positioned within the pool skimmer.

* * * * *